US006478495B2

(12) United States Patent
Ami et al.

(10) Patent No.: US 6,478,495 B2
(45) Date of Patent: Nov. 12, 2002

(54) CAPLESS WRITING INSTRUMENT

(75) Inventors: Kazuhiro Ami, Takasaki (JP); Yukinori Sawa, Saitama (JP); Takahiro Osada, Gunma (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/093,888

(22) Filed: Mar. 11, 2002

(65) Prior Publication Data

US 2002/0131807 A1 Sep. 19, 2002

(30) Foreign Application Priority Data

Mar. 13, 2001 (JP) ..... 2001-70607

(51) Int. Cl.[7] ..... B43K 5/16
(52) U.S. Cl. ..... 401/107; 401/108
(58) Field of Search ..... 401/107, 108, 401/99, 132, 29, 30, 31, 32, 33

(56) References Cited

U.S. PATENT DOCUMENTS 3,480,370 A * 11/1969 Koeln ..... 401/107
3,594,091 A * 7/1971 Bleuer ..... 401/107
4,711,592 A * 12/1987 Gregory ..... 401/107
6,033,141 A * 3/2000 Blaustein et al. ..... 401/107

* cited by examiner

*Primary Examiner*—David J. Walczak
(74) *Attorney, Agent, or Firm*—Burns, Doane, Swecker & Mathis, LLP

(57) ABSTRACT

In a capless writing instrument with its writing element arranged in the barrel cylinder so that a writing point of the writing element can come out and retract through a front-end opening of the barrel cylinder, an inner cap having a dome-like convex portion projected frontwards is arranged at the front-end part of the barrel cylinder, and the inner cap is formed of rubber or elastic resin, a slit-forming groove having a thin-film portion at the depressed bottom of the slit is formed from a position at the root of the dome-like inner cap to the opposite position at the root intersecting the substantially center of the convex portion.

4 Claims, 3 Drawing Sheets

CAPLESS WRITING INSTRUMENT

BACKGROUND OF THE INVENTION (1) Field of the Invention

The present invention relates to a capless writing instrument, in particular relates to a capless writing instrument having an anti-dryout mechanism.

(2) Description of the Prior Art

Conventionally, writing instruments, such as water-based and oil-based marker pens and water-based ball-point pens and fountain pens, are generally provided with a cap for sealing the tip part, in order to prevent the writing instrument from becoming unable to write due to dryout of ink at the tip of the writing element.

In the case of a writing instrument having a sealing cap for its writing point, it is necessary to remove and attach the cap every time the pen is used and this work bothers the user if the pen is used frequently. This is why many types of so-called capless writing instruments, which do not need to have a separate cap, have been proposed.

However, such capless writing instruments, in place of a cap, need to have a sealing mechanism for sealing the front-end part, in the narrow hollow interior of the writing instrument body, but such sealing mechanisms of conventional configurations are all complicated, needing many components, this results in complexity in assembly and increase in production cost.

As countermeasures against the above problem, as a sealing method of the writing tip, Japanese Utility Model Application Laid-Open Sho 49 No.32731(which will be called prior art example 1, hereinbelow) discloses a configuration in which a valve plate having cuts formed radially outwardly from the center therein is arranged at the front-end part inside the barrel cylinder of the writing instrument so that the writing tip can be projected through the cuts. Japanese Utility Model Application Laid-Open Hei 49 No.107421(which will be called prior art example 2, hereinbelow) discloses another configuration in which packings are arranged at the rear and front ends inside the barrel cylinder of the writing instrument so that the barrel cylinder interior can be sealed and the writing tip can be projected out through the front end packing against which the tip is abutted. Still another disclosure is proposed in Japanese Utility Model Application Laid-Open Sho 63 No.23084 (which will be called prior art example 3, hereinbelow), in which an elastic self-closing element having an opening is provided at the front part of a cap body so that the writing point of the barrel cylinder front end can projected out.

There are still other methods. Japanese Patent Application Laid-Open Hei 1 No.281999(which will be called prior art example 4, hereinbelow) discloses a configuration in which a sealing means is provided at the front end inside the barrel cylinder of a writing instrument so as to open and close the front end side of the sealed compartment in which the writing point of the writing element is held and the front end side of the sealed compartment is opened when the writing point is projected from the front end. Japanese Utility Model Application Laid-Open Sho 58 No.89394(which will be called prior art example 5, hereinbelow) discloses a method in which a sealing structure for sealing the writing point is hermetically fitted at the front-end part of the front barrel at the front end inside the barrel cylinder of the writing instrument so that it opens and closes the front part of the fixed sealing structure as the front barrel moves.

However, according to the above prior art examples 1, 2 and 3, since openings have been formed from the beginning at their sealing portions through which the pen tip is projected, any of these configurations has a sealability problem before use.

On the other hand, the method described in the prior art example 4 has the problem that the arrangement of the sealed compartment, seal opening and closing mechanism and the like becomes complicated. Similarly, the arrangement described in the prior art example 5 needs to have separate parts for the sealing enclosure with an opening mechanism, hence cannot avoid its becoming complicated.

SUMMARY OF THE INVENTION

The present invention has been devised in view of the above conventional problems and it is therefore an object of the present invention to provide a capless writing instrument with a simple structure which can seal the writing point inside the barrel cylinder and assures the sealability of the writing point before use.

In order to achieve the above object, the present invention is configured as follows:

In accordance with the first aspect of the present invention, a capless writing instrument, wherein a writing element is arranged in the barrel cylinder so that a writing point of the writing element can come out and retract through a front-end opening of the barrel cylinder, is characterized in that an inner cap formed of rubber or elastic resin is arranged at the front-end opening of the barrel cylinder and is formed with a strip-like thin-film portion that intersects the approximate center of the inner cap with respect to its axial direction, and the strip-like thin-film portion is broken forming a slit when the writing point is projected outside for the first time through the front-end opening of the barrel cylinder.

In accordance with the second aspect of the present invention, the capless writing instrument having the above first feature is characterized in that the strip-like thin-film portion is 0.01 to 1.0 mm wide and has a film thickness of 0.01 to 0.5 mm.

In accordance with the third aspect of the present invention, the capless writing instrument having the above first feature is characterized in that the inner cap is formed of sponge-like elastic material.

In accordance with the fourth aspect of the present invention, the capless writing instrument having the above second feature is characterized in that the inner cap is formed of sponge-like elastic material.

According to the present invention, the following effects can be obtained.

That is, according to the capless writing instrument of the present invention, since an inner cap formed of rubber or elastic resin is arranged at the front-end opening of the barrel cylinder, it is possible to keep the interior of the barrel cylinder sealed. Further, since the inner cap is formed with a strip-like thin-film portion that intersects the approximate center of the inner cap with respect to its axial direction, it is possible to assure the sealed state inside the barrel cylinder, over a prolonged period of time until it is used for the first time by projecting the writing point out.

Further, since the strip-like thin-film portion is broken so as to form a slit when the writing point is projected outside through the front-end opening of the barrel cylinder for the first time, it is possible to easily project the writing point through the slit. Since the inner cap is formed of rubber or elastic resin, the slit can be easily narrowed and kept in contact by virtue of the resiliency of the rubber or elastic resin, so that the sealed state can be re-established.

Since the strip-like thin-film portion is adapted to be 0.01 to 1.0 mm wide and have a film thickness of 0.01 to 0.5 mm, it is possible for the writing point to easily break the slit-forming groove without failure when the capless writing instrument is used for the first time. It is also possible to keep the opening of the slit closed in contact, hence maintain the sealed state of the interior of the barrel cylinder when it is not used even after breakage of thin-film portion.

Forming the inner cap of sponge-like elastic material enables easier and enhanced sealing of the interior of barrel cylinder.

DESCRIPTION OF THE PREFERRED EMBODIMENTS

Figure 1:
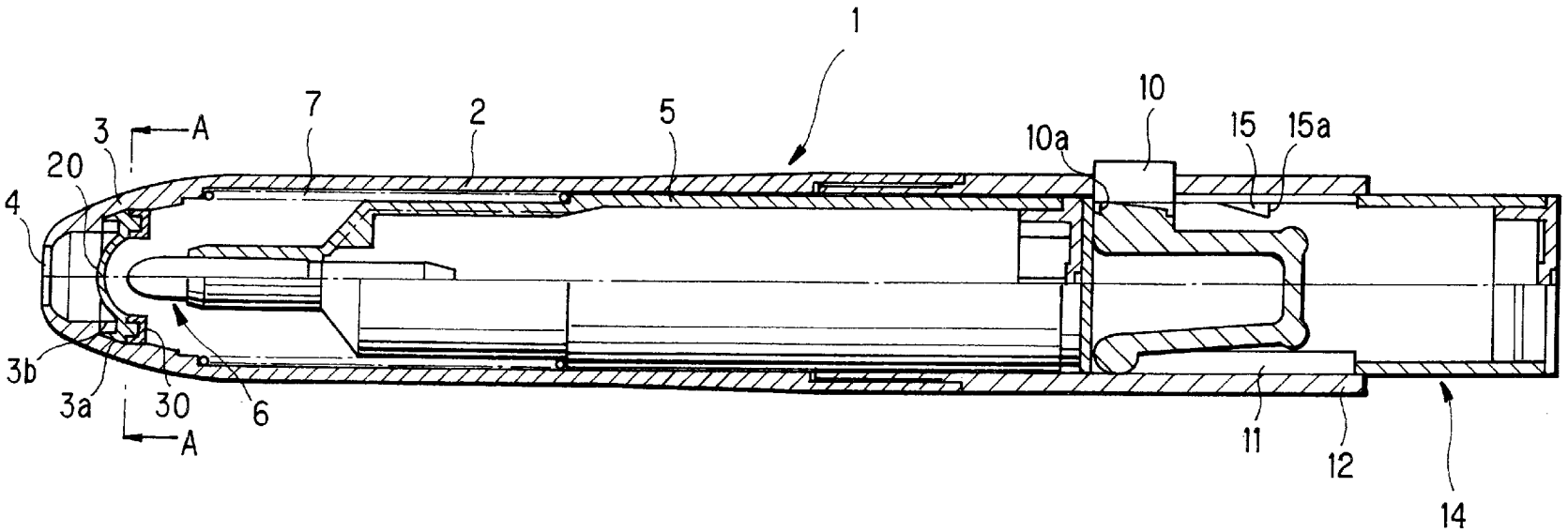
FIG. 1 is a sectional view showing an overall configuration of a capless writing instrument according to the embodiment of the present invention.

The embodiment of the present invention will hereinafter be described in detail with reference to the accompanying drawings.

FIG. 1 to FIGS. 3A, 3B and 3C show one embodiment of the present invention, and like reference numerals designate like components throughout these drawings.

Figure 2:
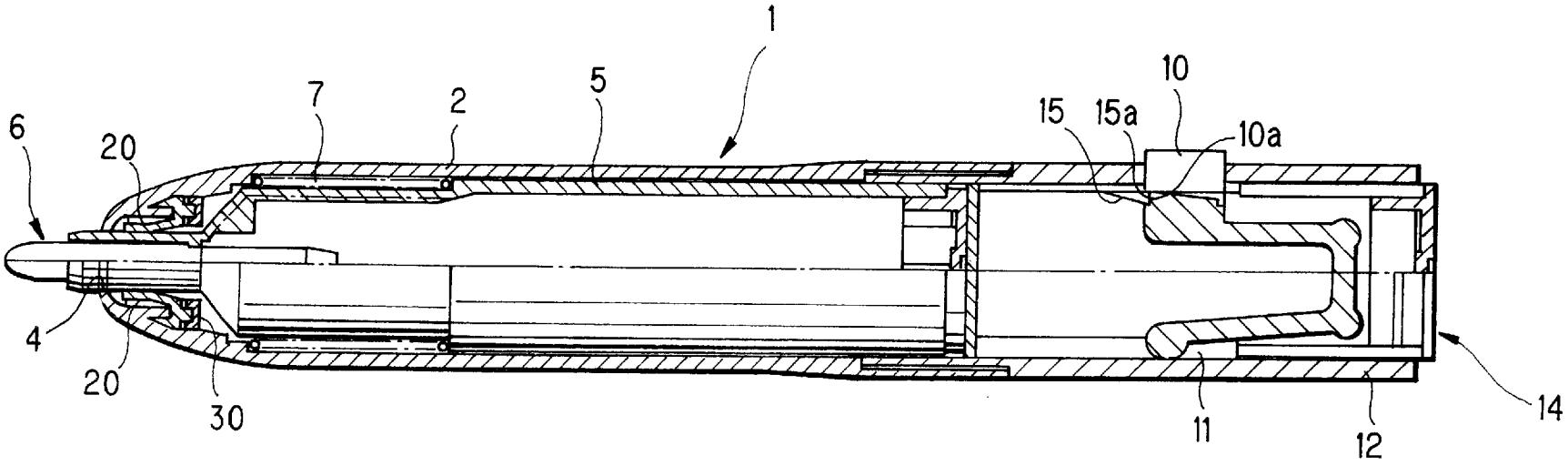
FIG. 2 is a sectional view showing the state of the capless writing instrument being used.
Figure 3A:
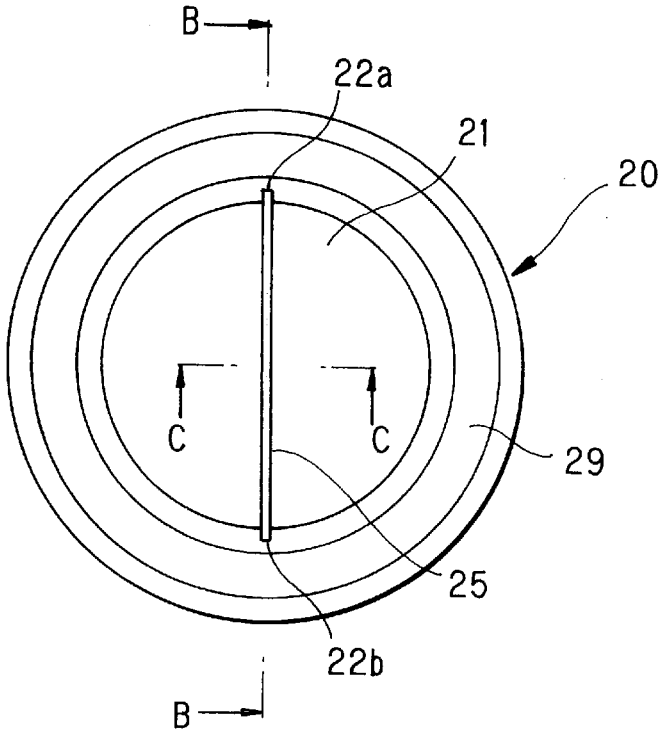
FIG. 3A is a sectional view cut along the A—A plane in FIG. 1.
Figure 3B:
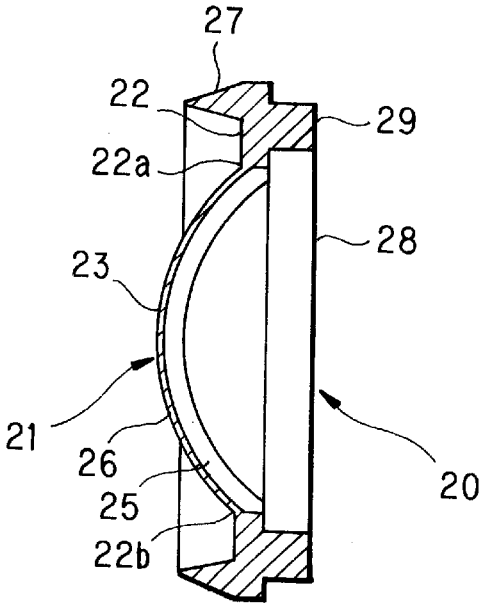
FIG. 3B is a sectional view cut along the B—B plane in FIG. 3A.
Figure 3C:
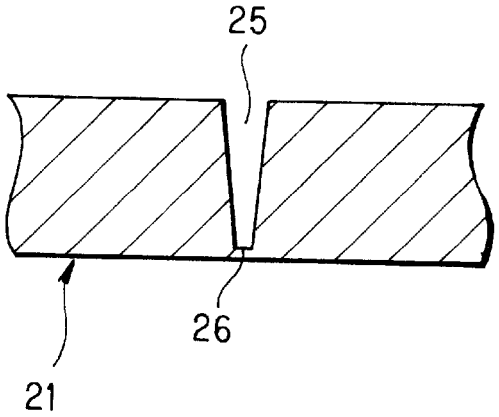
FIG. 3C is a sectional view cut along the C—C plane in FIG. 3A.

FIG. 1 is a sectional view showing an overall configuration of a capless writing instrument according to the embodiment of the present invention. FIG. 2 is a sectional view showing the state of the capless writing instrument being used. FIG. 3A is a sectional view cut along the A—A plane in FIG. 1, FIG. 3B is a sectional view cut along the B—B plane in FIG. 3A, and FIG. 3C is a sectional view cut along the C—C plane in FIG. 3A.

A capless writing instrument 1 according to the embodiment has a writing element body 5 disposed in a barrel cylinder 2 and is constructed so that a writing point 6 of writing element body 5 can be projected and retracted through an opening 4 formed at the front-end part, designated at 3, of the barrel cylinder 2.

This writing element body 5 is urged rearwards by a coil spring arranged in the front side along the inner periphery of barrel cylinder 2 and is supported at the rear end thereof by a stopper 10 which is provided at the rear part of barrel cylinder 2. A clicking portion 14 for projecting writing point 6 is disposed at the rear end 11 of writing element body 5 so that it sinks in and comes out of the barrel's rear end 12.

A wedge-like stopper catch 15, which is projected radially inwards toward the axis, extending in the axial direction as it becomes thicker toward the rear end, is formed at the rear part of the writing element body 5. An engagement portion 15*a* which is defined by a plane substantially perpendicular to the axis is formed at the rear end of the stopper catch 15 while a notch 10*a* opposing the engagement portion 15*a* is formed in the stopper 10.

When the writing element body 5 is pushed toward the front by clicking the rear end 11 forwards opposing the repulsive force of coil spring 7, writing point 6 projects through an opening 4 at the front end.

Provided at the front-end part 3 inside the barrel cylinder 2 is an inner cap 20 having a dome-shaped convex portion 21 projected frontwards, as shown in FIGS. 3A to 3C. This inner cap 20 is formed of rubber or elastic resin and has an unpierced, slit-forming groove 25 incised substantially linearly, when viewed from top, extending along the outline from a position 22*a* at root 22 of dome-like convex portion 21 to the opposite position 22*b* at the root, intersecting the approximate center 23 of the dome-like convex portion 21. The bottom of slit-forming groove 25 is formed by a strip-like thin-film portion 26.

The slit-forming groove 25, as shown in FIG. 3A, is incised from the inner side of the dome-like convex portion 21 with a groove width of 0.01 to 1.0 mm, being shaped in a wedge-like form, wider at the top opening side and narrower at the bottom side or on the thin-film portion 26 side. The thin-film portion 26 is formed having a thickness of 0.01 to 0.5 mm, along the outer surface of dome-like convex portion 21.

The inner cap 20, as shown in FIG. 3B, has a front-side sealing portion 27 which is continuously formed or encircled around the outer periphery of root 22 of dome-like convex portion 21, having a triangular cross-section and projecting forwards. Further, a rear-side sealing portion 29 is continuously and circumferentially formed on the rear end side 28 of root 22, with a smaller diameter than that of the front-side sealing portion 27, having a rectangular cross-section and projecting rearwards.

As seen in FIG. 1, a stepped inner cap fitting portion 3*a* is formed in the interior of front-end part 3 of the barrel cylinder 2, defining a seal groove 3*b* which the front-side sealing portion 27 fits.

Arranged on the rear side of the inner cap 20 is an inner cap holder 30 for fixing the inner cap 20 inside the front-end part 3.

The inner cap holder 30 is formed in an annular shape and fitted with its outer peripheral surface abutted against the inner wall of the front-end part 3 while the inner cap 20 is fitted inside front-end part 3, whereby the interior of barrel cylinder 2 is seal ed by the inner cap 20.

Next, the operation of the capless writing instrument according to the embodiment will be described.

To begin with, when the capless writing instrument 1 is not used, the writing point 6 is retracted to together with writing element body 5 within barrel cylinder 2, as shown in FIG. 1.

When the capless writing instrument 1 has never been used, no writing point 6 has penetrated through the slit-forming groove 25 formed in inner cap 20. That is, the thin-film portion 26 formed at the bottom of slit-forming groove 25 has not been broken. Accordingly, the interior of barrel cylinder 2 is perfectly kept airtightly so that it is possible to minimize evaporation of the applying fluid until the capless writing instrument 1 is used for the first time.

Next, when the capless writing instrument 1 is used, the user grips barrel cylinder 2 and pushes clicking portion 14 formed at the rear end of writing element body 5 forward opposing the repulsive force of coil spring 7, as shown in FIG. 2.

As writing element body 5 is inserted into barrel cylinder 2 from the state shown in FIG. 1 to the state shown in FIG.

2, stopper catch 15 formed at the rear end portion 11 of the writing element body 5 moves forwards and passes by stopper 10, reaching a position where the engagement portion 15*a* of stopper catch 15 opposes notch 10*a* at the end of the stopper 10. At this point, the clicking portion 14 is located at the end of barrel cylinder's rear end portion 12 while writing point 6 is set at a position where it is projected from opening 4 at the front-end part 3 of barrel cylinder 2.

In this state, when the clicking portion 14 is released, writing element body 5 is moved backward by the repulsive force of coil spring 7 but the engagement portion 15*a* is stopped by the notch 10*a*, so that the writing element body 5 will not be projected to the rear. Accordingly, writing point 6 is kept being projected from opening 4.

Since in the inner cap 20 slit-forming groove 25 formed on the inner side of dome-like convex portion 21 is connected only by the thin-film portion 26, the connected portion is minimum in strength. Hence, when writing point 6 is pushed forwards against the dome-like portion, the writing point can easily pierce slit-forming groove 25. Since the slit-forming groove 25 is formed along the spherical arc, inner cap 20 can be sectioned into two parts along this groove.

When the writing point 6 is retracted, pressing the flank of stopper 10 can easily release the engagement between notch 10*a* and engagement portion 15*a*, so that the writing element body 5 moves rearwards by the repulsive force of coil spring 7, where by writing point 6 is retracted into the barrel cylinder 2.

When writing point 6 is retracted, inner cap 20 tends to revert back to its original state by its own resiliency so that the slit-forming groove 25 having been spread apart by writing point 6 returns to its original state in which the opening clearance is minimum. Accordingly, when the capless writing instrument 1 is not used, it is possible to suppress evaporation of the applying fluid through the gap of slit-forming groove 25 to as low as possible.

Since the capless writing instrument 1 according to the embodiment is thus configured, provision of the inner cap 20 having slit-forming groove 25 through which writing point 6 can be projected and retracted, facilitates sealing of the interior of barrel cylinder 2 in which writing point 6 is accommodated. Further, since the slit-forming groove 25 is formed with thin-film portion 26, it is possible to secure the confinement of the barrel cylinder's interior until the capless writing instrument 1 is used for the first time.

Since inner cap 20 and thin-film portion 26 are formed of rubber or elastic resin, the enclosed condition can be maintained even after breakage of the inner cap because the resiliency of inner cap 20 after its breakage. urges the slit-forming groove 25 to close itself. Further, since the inner cap 20 is formed with front-side sealing portion 27 and rear-side sealing portion 29, it is possible to definitely seal the interior of barrel cylinder 2.

Specifying the film thickness of the thin-film portion 26 within the range from 0.01 to 0.5 mm, makes it possible for writing point 6 to easily break the thin-film portion 26 along slit-forming groove 25 without failure when the capless writing instrument 1 is used for the first time. Specifying the groove width of slit-forming gap 25 within the range from 0.2 to 1.0 mm makes it possible to keep the gap of slit-forming groove 25 closed, hence maintain the enclosed state inside barrel cylinder 2 even after breakage of thin-film portion 26.

According to the embodiment, since the front side of inner cap 20 is formed in a dome-like shape so as to project toward the front-end opening, the rigidity of the cap on the side fronting the outside can be enhanced, thus making it possible to definitely make slit 25 close tightly when the force to close slit 25 acts.

In the present embodiment, inner cap 20 is formed of rubber or elastic resin, but the present invention should not be limited to this. As a variational example, the inner cap may be formed of sponge-like rubber material or elastic resin material. With this configuration, the portion of inner cap 20 through which writing point 6 is projected, i.e., slit 25 can be made to easily deform and restore itself to the original shape. Accordingly, it is possible to enhance the contact of the slit 25 and hence improve the tightness as well as to prevent liquid from directly flowing out even when fluid seepage has occurred because the cap itself is liquid absorptive.

Further, though in the embodiment the front side of inner cap 20 is formed in a dome-like shape, the configuration of the inner cap 20 of the invention should not be limited to this. For example, the front side of the inner cap may be formed in a flat shape, concaved shape depressed inwards, conical shape or pyramidal shape.

Though in the embodiment, only one slit 25 which intersects the center of dome-like convex portion 21 of inner cap 20 is formed, the number and shape of slits of the present invention should not be limited to the above and a multiple number of slits may be formed. For example, three slits may be formed radially from the center of dome-like convex portion 21 so as to trisect the inner cap. Alternatively, four slits may be formed to quadrisect the inner cap or six slits may be formed.

In the embodiment, slit-forming groove 25 is formed on the inner side of the dome-like convex portion 21, leaving thin-film portion 26 at the bottom of the slit-forming groove 25 or forming it on the outer side of dome-like convex portion 21. However, the formed position of the thin-film portion and whether the thin-film portion is formed in combination with the slit-forming groove should not limit the present invention as long as a thin-film portion is formed. For example, the slit-forming groove may be formed on the front side of the inner cap with the thin-film portion on the inner side of the inner cap. Or, the thin-film portion maybe formed at the middle of the slit.

The capless writing instrument of the present invention should not be limited to the above illustrated example, but various modifications can be added as long as not departing the scope and spirit of the present invention.

As has been described heretofore, the capless writing instrument of the present invention presents the following effects. That is, since the inner cap formed of rubber or elastic resin and having an unpierced, strip-like thin-film portion is provided at the front-end part inside the barrel cylinder, it is possible to keep the enclosed state of the writing point inside the barrel cylinder before it is used. Further, the interior of the barrel cylinder in which the writing point is accommodated can be definitely sealed until the writing instrument is used for the first time and when the pen is used the writing point can be projected and retracted by a simple configuration.

What is claimed is:

1. A capless writing instrument, wherein a writing element is arranged in a barrel cylinder so that a writing point of the writing element can come out and retract through a front-end opening of the barrel cylinder, characterized in that an inner cap formed of rubber or elastic resin is arranged at the front-end opening of the barrel cylinder and is formed with a strip-like thin-film portion that intersects the approximate center of the inner cap with respect to its axial direction, and the strip-like thin-film portion is broken forming a slit when the writing point is projected outside for the first time through the front-end opening of the barrel cylinder.

2. The capless writing instrument according to claim 1, wherein the strip-like thin-film portion is 0.01 to 1.0 mm wide and has a film thickness of 0.01 to 0.5 mm.

3. The capless writing instrument according to claim 2, wherein the inner cap is formed of sponge-like elastic material.

4. The capless writing instrument according to claim 1, wherein the inner cap is formed of sponge-like elastic material.

* * * * *